US009951648B2

(12) United States Patent
Richter et al.

(10) Patent No.: US 9,951,648 B2
(45) Date of Patent: Apr. 24, 2018

(54) GUIDE BLADE RING FOR AN AXIAL TURBOMACHINE AND METHOD FOR DESIGNING THE GUIDE BLADE RING

(71) Applicant: Siemens Aktiengesellschaft, Munich (DE)

(72) Inventors: Christoph Hermann Richter, Ibbenburen (DE); Heinrich Stuer, Haltern (DE)

(73) Assignee: Siemens Aktiengesellschaft, Munich (DE)

( * ) Notice: Subject to any disclaimer, the term of this patent is extended or adjusted under 35 U.S.C. 154(b) by 378 days.

(21) Appl. No.: 14/391,876

(22) PCT Filed: Apr. 5, 2013

(86) PCT No.: PCT/EP2013/057170
§ 371 (c)(1),
(2) Date: Oct. 10, 2014

(87) PCT Pub. No.: WO2013/156322
PCT Pub. Date: Oct. 24, 2013

(65) Prior Publication Data

US 2015/0063985 A1 Mar. 5, 2015

(30) Foreign Application Priority Data

Apr. 16, 2012 (EP) ..... 12164299

(51) Int. Cl.
*F01D 9/04* (2006.01)
*F01D 25/04* (2006.01)
(Continued)

(52) U.S. Cl.
CPC ..... *F01D 25/04* (2013.01); *F01D 5/10* (2013.01); *F01D 5/142* (2013.01); *F01D 5/16* (2013.01);
(Continued)

(58) Field of Classification Search
CPC ..... F01D 5/142; F01D 25/04; F01D 9/041
See application file for complete search history.

(56) References Cited

U.S. PATENT DOCUMENTS 3,883,264 A * 5/1975 Rao ..... F01D 1/04 415/119
4,253,800 A 3/1981 Fujisawa
(Continued)

FOREIGN PATENT DOCUMENTS

CN 1828024 A 9/2006
DE 102009033618 A 1/2011
(Continued)

OTHER PUBLICATIONS

JP Office Action dated Sep. 12, 2016, for JP application No. 2015-506171.
(Continued)

*Primary Examiner* — Woody Lee, Jr.
(74) *Attorney, Agent, or Firm* — Beusse Wolter Sanks & Maire

(57) ABSTRACT

A method for designing a stage for an axial turbomachine having a guide blade ring and a rotor blade ring arranged downstream of the guide blade ring is provided. The method includes: profiling a guide blade ring having guide blades arranged regularly over the circumference of the guide blade ring in accordance with basic aerodynamic and mechanical conditions; moving at least one profile section of at least one of the guide blades in the circumferential direction in such a way that the pitch angle for the at least one guide blade and a guide blade arranged adjacent thereto varies over the blade height in such a way that during operation of the axial turbomachine the departing flow formed downstream of the guide blade ring is irregularly formed over the circumfer-
(Continued)

ence of the axial turbomachine, such that the vibration excitation of the rotor blades of the rotor blade ring is low.

13 Claims, 2 Drawing Sheets

(51) Int. Cl.
*F01D 5/14* (2006.01)
*F01D 5/16* (2006.01)
*F01D 5/10* (2006.01)

(52) U.S. Cl.
CPC ..... *F01D 9/041* (2013.01); *F05D 2230/00* (2013.01); *F05D 2260/961* (2013.01); *Y10T 29/4932* (2015.01)

(56) References Cited

U.S. PATENT DOCUMENTS

| | | | | |
|---|---|---|---|---|
| 5,167,489 | A * | 12/1992 | Wadia | B64C 11/18 415/182.1 |
| 5,575,620 | A * | 11/1996 | Haller | F01D 5/141 415/192 |
| 6,126,394 | A | 10/2000 | Matsuda | |
| 2002/0064458 | A1 | 5/2002 | Montgomery | |
| 2005/0019157 | A1 | 1/2005 | Tominaga et al. | |
| 2008/0148564 | A1* | 6/2008 | Burton | F01D 5/141 29/888.02 |
| 2009/0169371 | A1 | 7/2009 | Tsuchiya et al. | |
| 2010/0247310 | A1 | 9/2010 | Fazari | |
| 2012/0099961 | A1* | 4/2012 | Delvaux | F01D 5/142 415/62 |
| 2013/0094942 | A1* | 4/2013 | MacKay | F01D 5/141 415/148 |
| 2014/0245741 | A1* | 9/2014 | He | F01D 5/141 60/746 |

FOREIGN PATENT DOCUMENTS

| | | | |
|---|---|---|---|
| EP | 1422382 | A1 | 5/2004 |
| EP | 0985801 | B1 | 9/2004 |
| JP | 02118102 | U | 9/1990 |
| JP | H0211802 | U | 9/1990 |
| JP | H01026068 | U | 9/1990 |
| JP | H0610610 | A | 1/1994 |
| JP | H06272504 | A | 9/1994 |
| JP | H0861002 | A | 3/1996 |
| JP | H10184304 | A | 7/1998 |
| JP | 2000045704 | A | 2/2000 |
| JP | 2000328902 | A | 11/2000 |
| JP | 2003074306 | A | 3/2003 |
| JP | 2004100553 | A | 4/2004 |
| JP | 2008157247 | A | 7/2008 |
| JP | 2012087788 | A | 5/2012 |
| WO | 03018961 | A1 | 3/2003 |
| WO | 2007063768 | A1 | 6/2007 |

OTHER PUBLICATIONS

JP Notice of Allowance dated May 22, 2017, for JP patent application No. 2015-506171.

* cited by examiner

GUIDE BLADE RING FOR AN AXIAL TURBOMACHINE AND METHOD FOR DESIGNING THE GUIDE BLADE RING

CROSS REFERENCE TO RELATED APPLICATIONS

This application is the U.S. National Stage of International Application No. PCT/EP2013/057170 filed Apr. 5, 2013, and claims the benefit thereof. The International Application claims the benefit of European Application No. EP12164299 filed Apr. 16, 2012. All of the applications are incorporated by reference herein in their entirety.

FIELD OF INVENTION

The invention relates to a guide blade ring for an axial turbomachine, to the axial turbomachine and to a method for designing the guide blade ring.

BACKGROUND OF INVENTION

In a steam turbine, steam is expanded to generate rotational energy. The steam turbine has a plurality of stages, each stage having a guide blade ring with a plurality of guide blades and a rotor blade ring with a plurality of rotor blades. The rotor blades are fitted to the shaft of the steam turbine and rotate during operation of the steam turbine; the guide blades are fitted to the housing of the steam turbine and are stationary. When the steam turbine is in operation, the blades may be excited into vibration. The vibration is characterized in that a vibration node is arranged on the blade roots of the blades. The stress loading due to the vibration is high particularly at the blade roots, such that material fatigue may arise at the blade roots, making it necessary to exchange the guide blades, which is cost-intensive.

A flow duct, through which the steam flows when the steam turbine is in operation, is formed between in each case two guide blades arranged adjacent to one another. The velocity distribution of the flow downstream of the guide blade ring has, in the region of the trailing edges of the guide blades, local velocity minima which are termed wake depressions. The wake depressions may excite the rotor blades, arranged downstream of the guide blade ring, to vibrate.

SUMMARY OF INVENTION

Embodiments of the invention are based on an object of achieving a stage for an axial turbomachine, the axial turbomachine having the stage and a method for designing the stage, wherein the abovementioned problems are overcome and the rotor blades of the stage have a long service life.

The method according to an embodiment of the invention for designing a stage for an axial turbomachine having a guide blade ring and a rotor blade ring arranged downstream of the guide blade ring has the following steps of: profiling a guide blade ring with guide blades arranged regularly around the circumference of the guide blade ring in accordance with aerodynamic and mechanical boundary conditions; shifting at least one profile section of at least one of the guide blades in the circumferential direction such that the dividing angle for the at least one guide blade and a guide blade arranged adjacent thereto varies over the blade height such that, when the axial turbomachine is in operation, the form of the wake formed downstream of the guide blade ring is irregular over the circumference of the axial turbomachine such that the vibration excitation of the rotor blades of the rotor blade ring is low.

When profiling, various profile sections are designed in accordance with the boundary conditions. Each guide blade is composed of the profile sections, wherein a threading point is assigned to each profile section, and all the profile sections are "threaded" onto a threading line by means of their threading points. According to an embodiment of the invention, the at least one profile section is shifted such that the threading point of the at least one profile section no longer lies on the original threading line.

The dividing angle is the angle between two connecting lines which proceed from a common point on the axis of the axial turbomachine and run perpendicular to the axis and end at corresponding points on the surfaces of the two adjacent guide blades. The two corresponding points are two points at the same radial distance from the axis of the axial turbomachine and are arranged in each case at identical points on the guide blades, i.e. for example a point either on the pressure side, on the suction side, on the leading edge or on the trailing edge of the respective guide blade. In the case of the guide blade ring having guide blades arranged regularly about the circumference, the dividing angle is the nominal dividing angle $2\pi/n$, where n is the number of guide blades arranged in the guide blade ring.

The rotor blades may be subjected to two different vibration excitation mechanisms, namely flutter and a forced response. Flutter is a self-excited vibration in which energy from the flow is transferred into the vibrations of the rotor blades. Flutter is excited by small blade vibrations, which can be self-energizing, such that the blade vibrates more strongly with every subsequent vibration period. This can cause the rotor blades to break off. The fact that the dividing angle varies means that, in the case of two adjacent ducts, the flow deflection angle is different, whereby the flow from the guide blade ring to the rotor blade ring is irregular over the circumference of the axial turbomachine. This changes the loading on the rotor blades in the course of a rotation, which advantageously reduces flutter.

The forced vibration results because of a periodic excitation of the rotor blades. One duct, through which a fluid of the axial turbomachine can flow, is in each case arranged between two adjacent guide blades. By virtue of the changing dividing angle, the wake depressions corresponding to the two ducts have a different shape and circumferential position. When the axial turbomachine is in operation, the downstream rotor blades enter the wake depressions, whereby the rotor blades experience non-stationary incident flow, which can lead to vibration excitation of the rotor blades. The fact that the wake depressions are made to be non-homogeneous over the circumference means that the vibration excitation is non-periodic, whereby the forced vibrations of the rotor blades are also advantageously weak.

Shifting the at least one profile section preferably occurs on a shift path which, for each of the two adjacent guide blades, is at most 10% of the extent of the duct between the two guide blades in the circumferential direction. The profile sections are preferably shifted such that the guide blade is inclined against a guide blade arranged adjacent thereto. In this case, the dividing angle varies in linear fashion over the blade height.

The profile sections are preferably shifted such that at least one of two guide blades arranged adjacent to one another is curved. Here, the dividing angle varies in non-linear fashion over the blade height. The guide blades, in which profile sections are shifted, are preferably arranged distributed symmetrically about the axis of the axial turbomachine. The downstream flow from the guide blade ring is thus symmetric.

The guide blades are preferably designed such that none of the eigenfrequencies of the rotor blades corresponds with the rotational frequency of the axial turbomachine or with a multiple of the rotational frequency up to and including the eighth multiple of the rotational frequency. It is thus advantageously ensured that, when the axial turbomachine is in operation, there is no coupling between the rotation of the axial turbomachine and the vibrations of the rotor blades. The coupling can lead to an increased energy input from the flow into the vibrations.

The profile sections preferably lie on a cylindrical surface or a conical surface, whose axes coincide with the axis of the axial turbomachine, on an $S_1$ flow surface or in a tangential plane of the axial turbomachine. The $S_1$ flow surface extends in the circumferential direction and in the axial direction of the axial turbomachine and describes a surface that follows an idealized flow. The method preferably has the step of: matching the at least one profile section to the aerodynamic boundary conditions which are changed after the shift.

The stage according to an embodiment of the invention is designed using the method according to another embodiment of the invention. The axial turbomachine according to an embodiment of the invention has the stage, in particular as the last, downstream stage of the axial turbomachine. The rotor blades in the last stage of the axial turbomachine are those rotor blades having the longest radial extent in the axial turbomachine and are thus particularly susceptible to vibration excitation. A non-periodic vibration excitation of the rotor blades is thus advantageous particularly in the last stage.

BRIEF DESCRIPTION OF THE DRAWINGS

Embodiments of the stage according to aspects of the invention are described below with reference to the appended schematic drawings, in which.

DETAILED DESCRIPTION OF INVENTION

Figure 1:
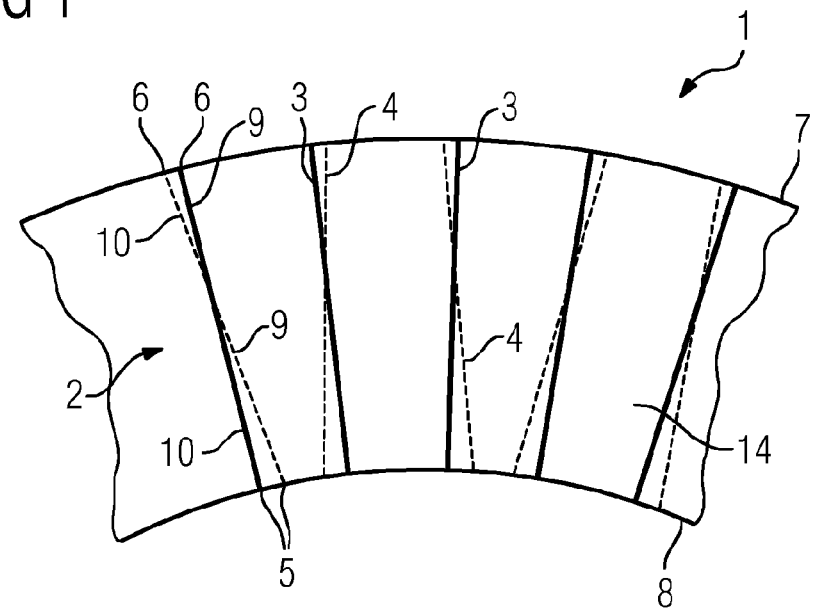
FIGS. 1 to 3 each show a section of a plan view of one of the embodiments of a guide blade ring of a stage according to an embodiment of the invention.
Figure 2:
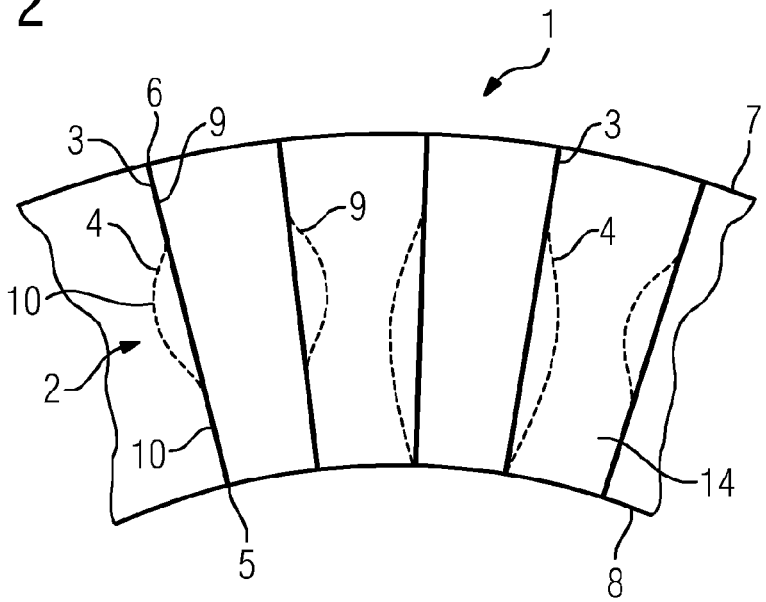
Figure 3:
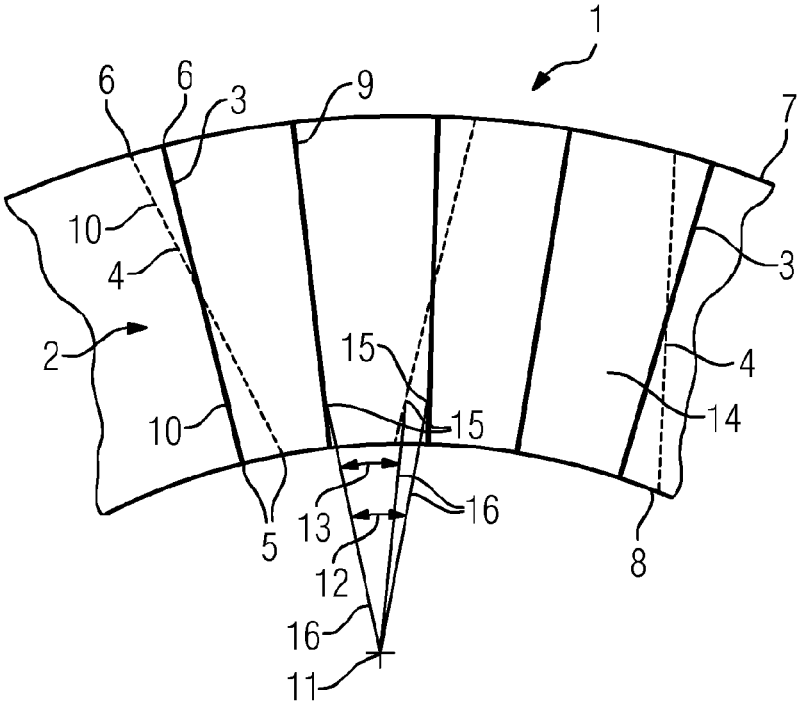

As shown in FIGS. 1 to 3, an axial turbomachine 1 has a guide blade ring 2 and a casing 7. The guide blade ring 2 has a plurality of guide blades 3, 4, with each of the guide blades 3, 4 having a blade root 5, a blade tip 6, a pressure side 9 and a suction side 10. Each of the guide blades 3, 4 is securely attached to the casing by means of its blade tip 6 and to a hub ring 8 by means of its blade root 5. A duct 14, in which a working fluid can be made to flow, is formed between two adjacent guide blades 3, 4. FIGS. 1 to 3 each show the trailing edge of the guide blades 3, 4.

FIG. 3 shows, by way of example, a dividing angle 13 of the axial turbomachine 1. A surface point 15 is represented on each of the two adjacent guide blades 3, 4, on the trailing edges of the guide blades 3, 4. In that context, the two surface points 15 are at the same distance from the axis 11 of the axial turbomachine 1. FIG. 3 also shows two connection lines 16 which proceed from each of the two surface points 15, run perpendicular to the axis 11 of the axial turbomachine 1 and each end at the same point on the axis 11 of the axial turbomachine 1. The two connection lines 16 enclose the dividing angle 13.

FIGS. 1 to 3 show the guide blade ring 2 before shifting at least one profile section and after shifting the at least one profile section. FIGS. 1 to 3 show guide blades 3 before shifting (solid lines) and guide blades 4 after shifting (dashed lines). The guide blades 3 are distinguished by the fact that they have the same dividing angle 13 for every guide blade 3 and for every surface point 15, namely the nominal dividing angle 12. The nominal dividing angle 12 is given by $2\pi/n$, where n is the number of guide blades 3 in the guide blade ring 2.

In FIG. 1, the profile sections are shifted such that the guide blades 4 are inclined in comparison to the guide blades 3. In that context, the guide blade ring 2 has, after shifting, respectively equal pairs of adjacent guide blades 4. The pairs are distinguished by the fact that the blade root 5 of one guide blade 4 of the pair is shifted in one circumferential direction of the guide blade ring 2 and the blade tip 6 is shifted in the other circumferential direction, counter to the first circumferential direction. The other guide blade 4 of the pair is inclined counter to the first guide blade 4 of the pair, i.e. the blade root 5 of the other guide blade 4 of the pair is shifted in the other circumferential direction and the blade tip 6 of the other guide blade 4 is shifted in the first circumferential direction. The guide blades 4 thus arranged lead to a linear variation in the dividing angle 13 over the blade height, i.e. depending on the radial distance from the axis 11 of the axial turbomachine 1. In FIG. 1, the guide blade ring 2 is entirely formed by the identical pairs. It is also conceivable for the guide blade ring 2 to be alternately formed by the pairs and by the guide blades 3 without shifted profile sections. In that context, one guide blade 3 or a plurality of guide blades 3 may in each case be provided between two pairs, the disruption of the aeroelastic coupling being more effective if only one guide blade 3 is provided.

The guide blade ring 2 from FIG. 2 also has pairs of guide blades 4. The guide blades 4 of the pairs are curved such that the guide blades 4 have a convexity. Here, one guide blade 4 of the pair has a convexity in one circumferential direction and the other guide blade 4 of the pair has a convexity in the other circumferential direction. It is also conceivable for the guide blades 4 to have a multiplicity of convexities which are arranged either on the same side of the guide blades 3 in the circumferential direction or on both sides of the guide blades 4 in the circumferential direction. Furthermore, it is possible to vary the shape of the convexity from one guide blade 4 to another in order to particularly effectively disrupt the aeroelastic coupling. By virtue of the fact that the guide blades 4 are curved, the dividing angle 13 varies in non-linear fashion over the blade height. In FIG. 2 also the guide blade ring 2 is formed entirely from the pairs and here, too, it is conceivable that one or more guide blades 3 is arranged between two pairs. It is also conceivable for a curved guide blade 4 and a guide blade 3 to be arranged in alternation.

In FIG. 3, every second guide blade 3, 4 in the guide blade ring 2 is inclined in comparison with the corresponding guide blades 3. The guide blades 4 so inclined have their blade roots 5 alternately shifted in one circumferential direction or in the other circumferential direction and have their blade tips 6 alternately shifted in the other circumferential direction or in the first circumferential direction. In FIGS. 1 to 3, the deviations of the guide blades 4 with respect to the guide blades 3 represent a maximum of 10% of the available extent of the ducts 14 in the circumferential direction. The deviations are obtained by profile sections of the guide blades 3 being shifted in the circumferential direction. The profile sections of the guide blades 3 may lie on a cylindrical surface or a conical surface which is symmetrical about the axis 11, in a tangential plane of the axial turbomachine 1 or on an $S_1$ flow surface.

Figure 4:
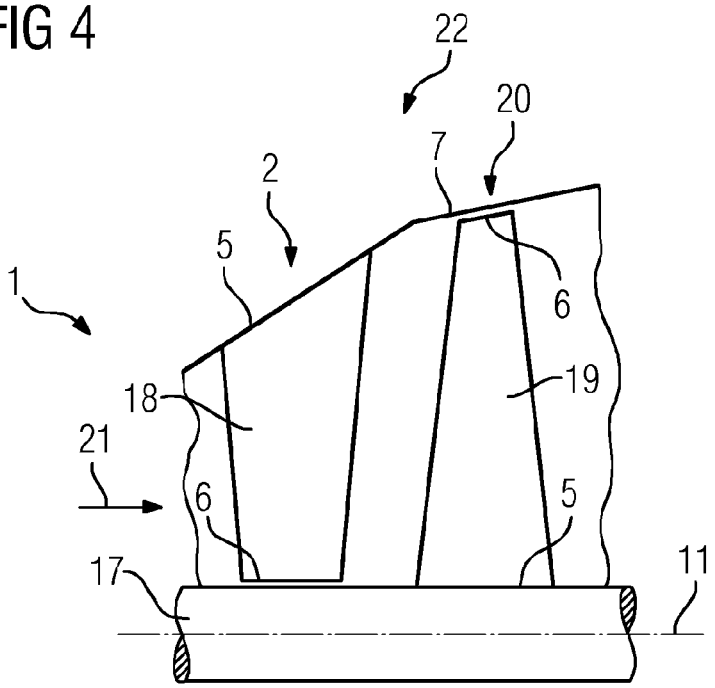
FIG. 4 shows a longitudinal section through the stage according to an embodiment of the invention.

FIG. 4 shows a longitudinal section through the axial turbomachine 1 with a main flow direction 21 and with the stage 22 according to an embodiment of the invention. The stage 22 has the guide blade ring 2 and a rotor blade ring 20 arranged downstream of the guide blade ring 2. A guide blade 18 and a rotor blade 19 are respectively shown. A hub 17, which rotates about the axis 11 when the axial turbomachine 1 is in operation, is also represented. The guide blade 19 is attached to the casing 7 and the rotor blade 19 is attached to the hub 17. When the axial turbomachine 1 is in operation, a flow having a non-homogeneous velocity distribution develops downstream of the guide blade ring 2. This causes the loading on the rotor blades 19 to change over the course of a rotation, whereby flutter in the rotor blades 19 is advantageously reduced. The method for designing a stage 22 for an axial turbomachine 1 having a guide blade ring 2 and a rotor blade ring 20 arranged downstream of the guide blade ring 2 is preferably carried out as follows: profiling a guide blade ring 2 with guide blades 3 arranged regularly around the circumference of the guide blade ring 2 in accordance with aerodynamic and mechanical boundary conditions; shifting at least one profile section of at least one of the guide blades 3 in the circumferential direction such that the dividing angle 13 for the at least one guide blade 4 and a guide blade 4 arranged adjacent thereto varies over the blade height such that, when the axial turbomachine 1 is in operation, the form of the wake formed downstream of the guide blade ring 2 is irregular over the circumference of the axial turbomachine such that the vibration excitation of the rotor blades 19 of the rotor blade ring 20 is low; matching the at least one profile section to the aerodynamic boundary conditions which are changed after the shift.

Although embodiments of the invention have been illustrated and described in more detail with reference to the exemplary embodiments, the invention is not restricted by the disclosed examples and other variations may be derived therefrom by a person skilled in the art without departing from the scope of protection of the invention.

The invention claimed is:

1. A method related to a stage for an axial turbomachine having a guide blade ring and a rotor blade ring arranged downstream of the guide blade ring, comprising:

profiling a guide blade ring with guide blades arranged regularly around a circumference of the guide blade ring;

shifting a blade root of at least one profile section of at least one of the guide blades in a first circumferential direction to provide a first circumferential offset relative to the guide blade ring with the guide blades arranged regularly around the circumference of the guide blade ring, and shifting a blade tip of the at least one profile section in a second circumferential direction counter to the first circumferential direction to provide a second circumferential offset relative to the guide blade ring with the guide blades arranged regularly around the circumference of the guide blade ring, such that when the axial turbomachine is in operation, a form of a wake formed downstream of the guide blade ring is irregular over the circumference; and manufacturing a stage for the axial turbomachine in accordance with the at least one shifted profile section.

2. The method as claimed in claim 1, wherein shifting the at least one profile section occurs on a shift path which, for each of the two adjacent guide blades, is at most 10% of the extent of the duct between the two guide blades in the circumferential direction.

3. The method as claimed in claim 1, wherein the profile sections are shifted such that the guide blade is inclined against a guide blade arranged adjacent thereto.

4. The method as claimed in claim 1, wherein a convexity of two guide blades arranged adjacent to one another are varied such that a dividing angle between the two blades varies in non-linear fashion over a height of the two adjacent guide blades.

5. The method as claimed in claim 1, wherein the guide blades, in which profile sections are shifted, are arranged distributed symmetrically about an axis of the axial turbomachine.

6. The method as claimed in claim 1, wherein the guide blades are designed such that none of the eigenfrequencies of the rotor blades corresponds with the rotational frequency of the axial turbomachine or with a multiple of the rotational frequency up to and including the eighth multiple of the rotational frequency.

7. The method as claimed in claim 1, wherein the profile sections lie on a cylindrical surface or a conical surface, whose axes coincide with the axis of the axial turbomachine, on an $S_1$ flow surface or in a tangential plane of an axial turbomachine.

8. The method as claimed in claim 1, further comprising:

matching the at least one profile section to aerodynamic boundary conditions which are changed after the shift.

9. A stage for an axial turbomachine which is designed using a method as claimed in claim 1.

10. An axial turbomachine comprising a stage as claimed in claim 9.

11. The axial turbomachine of claim 10 wherein the stage comprises a last, downstream stage of the axial turbomachine.

12. The method as claimed in claim 1, wherein guide blades with shifted profile sections are separated by at least one guide blade without a shifted profile section about the circumference.

13. A method comprising:

profiling a guide blade ring of an axial turbomachine with guide blades arranged around a circumference;

shifting a root or a tip of a first of the guide blades in a circumferential direction to provide a first circumferential offset relative to the first of the guide blades without the shifted root or tip;

shifting a root or a tip of a second of the guide blades in a circumferential direction to provide a second circumferential offset relative to the second of the guide blades without the shifted root or tip;

wherein the first and second of the guide blades are separated about the circumference by at least one guide blade without a shifted root or tip; and manufacturing the guide blade ring.

* * * * *